United States Patent [19]

Zossimas et al.

[11] 4,377,915

[45] Mar. 29, 1983

[54] CORNER FRAME

[75] Inventors: Efthimios Zossimas; Michael Dodis, both of Toronto, Canada

[73] Assignee: Framelok Inc., Toronto, Canada

[21] Appl. No.: 265,055

[22] Filed: May 19, 1981

[51] Int. Cl.[3] ..... G09F 1/10

[52] U.S. Cl. ..... 40/155

[58] Field of Search ..... 40/152, 155; 403/403, 403/402

[56] References Cited

U.S. PATENT DOCUMENTS

| | | | |
|---|---|---|---|
| 2,654,451 | 10/1953 | Schnidgal | 40/152 |
| 2,790,259 | 4/1957 | Havens | 40/155 |
| 3,317,227 | 5/1967 | Nijhuis | 40/152 |
| 3,965,601 | 6/1976 | Nielsen | 40/155 |

*Primary Examiner*—Gene Mancene
*Assistant Examiner*—Wenceslao J. Contreras
*Attorney, Agent, or Firm*—Birch, Stewart, Kolasch & Birch

[57] ABSTRACT

A novel picture frame is provided herein. The picture frame is made up of a plurality of unitary members having identically shaped cross-sections and joined end-to-end to enclose a predetermined area. Each of the members has, in cross-section, a channel having a base, a pair of opposed side walls and a pair of inwardly directed flanges to define an open face and a slot to receive a material to be displayed in the area. The picture frame includes an L-shaped locking bracket within the channel. The locking bracket is of generally rectangular, hollow, cross-section, having an upper roof, a pair of opposed side walls and a split base, the split base having mutually opposed beveled edges. One or more internally threaded holes are provided in the roof with a set screw provided in each one. When the set screw is tightened, it engages the split base and forces selected portions at the opposed side walls of the locking bracket against the corresponding opposed side walls of the channel.

17 Claims, 10 Drawing Figures

CORNER FRAME

BACKGROUND OF THE INVENTION (i) Field of the Invention

This invention relates to a corner which is specially adapted to provide a frame that will provide not only a pleasing appearance when assembled but also can be easily assembled or disassembled by anyone.

(ii) Description of the Prior Art

Anyone wishing to frame a picture, diploma or similar article is presently met with the problem of obtaining a proper size frame and mounting the object to be framed within it. In most instances this requires the assistance of a skilled commercial framer who will be able to cut the frame to proper size from wooden molding elements available to him, assemble it with nails and/or glue and then mount the object to be framed within it. An additional step of wedging the article within the frame evenly is frequently necessary. As is obvious, many people are not able to construct such frames because of lack of knowledge as to how to build a frame, no access to the necessary materials or inability to obtain or use the required tools. For those unskilled in such work, the frame when assembled by them lacks attractiveness, is weak and frequently separates at the joints.

Picture frames made from extruded aluminum moldings have also been used in the past. With such moldings, it is customary to provide a clamping assembly for interconnecting the mitered ends of the moldings in the frame. These picture frames often are available in unassembled kit form. The most common technique for assembling the picture frame sections into the complete frame includes the provision of channels on the rear surface of each of the frame sections, with the channels of adjacent sections in the corners of the frame meeting in L-shaped configuration. Typically, the adjacent ends of the frame sections have been assembled, to form a corner of the frame, by placing an L-shaped bracket at each corner of the frame so that each leg of the bracket extends into the channel of one of the adjacent frame sections. Each of the bracket legs is secured to its associated framing section by suitable locking means, usually a screw which is urged firmly against the rearwardly facing, inner surface of the channel formed on the rear surface of each framing member.

While the foregoing technique has been used widely, it does have some disadvantages. For example, the joint at the adjacent ends of the frame sections tend to loosen with time. This may be the result of the relatively soft character of aluminum which is used typically for the extruded frame sections. Additionally, because frames of the type described may be assembled and disassembled with relative ease, these frames often are used repeatedly to frame a number of different pictures. Because the screws which ordinarily bear firmly against the rearwardly facing surface of the aluminum channel tend to mar the channel and form depressions in the channel, the surface of the channel becomes irregular which reduces the effective holding power of the screws. This aggravates the inherent difficulty of typical prior devices which, even when unmarred by repetitive tightening of the screws, tends to make a poor and sometimes loose joint at the corners where the adjacent frame sections meet.

Many proposals have been offered to overcome such problems.

Canadian Pat. No. 594,004 issued Mar. 8, 1960 to L. I. Thompson merely discloses a picture frame construction involving the use of "L"-shaped members at the corner, cooperating with projections in the interior of the hollow frame members, with screws engaging the members and holding them together.

Canadian Pat. No. 881,000 issued Sept. 14, 1971 to Frameguild discloses a picture frame construction having the "L"-shaped corner members and screws to force the upper portion of the hollow frame. In accordance with that patent, a readily assembled and disassembled frame is provided with great strength and rigidity by the use of a plurality of side members in combination with simple locking and supporting means at the corners of the frame. In such frame, each side member is provided with an undercut channel at each end. A locking joint with portions angled at right angles is slipped into the undercut channels of adjoining side members, thus bringing the side members together in the proper relationship. Because the ends of each side member are usually beveled, their joinder forms a mitered joint. Once the locking joints place the side members in proper relationship, means associated with the locking joints are used to wedge, or otherwise firmly lock, the joints into the undercut channels. At this point the side members are not only correctly aligned but firmly fastened to each other. When all four sides of the frame are thus locked together, the resulting frame is not only rigid and strong but is attractive.

Canadian Pat. No. 925,292 issued May 1, 1973 to Artistic Woodwork relates to spaced-apart "L"-shaped members engaging, by means of screws, both faces of a frame flange. In such patent, a picture frame is provided which comprises a series of interconnected molding pieces mitered at their free ends to form a picture frame. The molding pieces have a picture retaining channel on their inwardly directed side and a clamping channel in their back surface. The clamping channel has a pair of diametrically opposed rails, one on each side wall of the clamping channel, and a clamping assembly in the channel extends between each of the interconnected molding pieces. The clamping assembly has opposed jaws which grip with the rails of the clamping channel to maintain the picture in a set up position.

Canadian Pat. No. 988,298 issued May 4, 1976 to Arlington Aluminum relates to a corner construction in which a screw inserted at a 45° angle expands the corner interlocking square bars to hold the frame together.

Canadian Pat. No. 1,035,952 issued Aug. 8, 1968 to H. Neilsen provides a corner joint in which the "L"-shaped member is actually screwed into the "L"-shaped bearing plate which is urged into frictional engaging contact with the frame. In that patent, the invention includes the forming of the L-shaped bracket in cooperation with the configuration of the channel which receives the bracket so that when the fastening means, such as the screws of the bracket are tightened, cantilevered wall extensions of the frame sections will twist or cant slightly inwardly to cause the beveled corners of the frame sections to be urged snugly against each other, thus enhancing the front appearance of the frame by avoiding gaps at the corner and also providing a tighter fit. In one embodiment this is achieved by forming selected surfaces of the channel at a slight bevel. In another embodiment, the L-shaped brackets have a beveled and/or wedge-shaped cross-section which cooperate with the channel configuration to achieve the desired effect.

Canadian Pat. No. 1,041,762 issued Nov. 7, 1978 to O. B. Kapstad provides a corner construction in which the "L"-shaped corner joint has a pair of spring gripping tongues thereon.

Canadian Pat. No. 1,092,352 issued Dec. 30, 1980 to General Systems Research Ltd. provides a corner construction in which the "L"-shaped members are held by screws between two spaced-apart webs of the frame.

Deficiencies of the Prior Art

It is apparent from the foregoing that it would be most desirable to provide a frame that is not only aesthetically pleasing but easy to assemble by anyone. Adding to this the quality of rigidity and strength, freedom from separation, and the ability to be assembled and disassembled easily and quickly without the need for tools and there is offered a most useful invention.

Summary of the Invention

Aims of the Invention

One object of this invention is to provide an improved arrangement for locking the adjacent ends of preformed frame sections together.

Another object of this invention is to provide an improved framing arrangement which ensures that beveled mating ends of frame sections will fit snugly adjacent each other and avoid unsightly gaps or cracks.

Yet another object of this invention is to provide a picture frame assembly having a strong clamping assembly for retaining the mitered ends of a metal picture frame molding together.

Statements of Invention

This invention provides, by one embodiment, an improvement in a corner connector for a frame having an open rectangular channel. The corner connector is an L-shaped member of generally rectangular cross-section. Each arm of the "L" is provided with an internally threaded aperture through one face thereof. A screw, having a frusto-conical end of lesser diameter than the upper open end of the aperture, is disposed in the internally threaded aperture. Operating means, actuated, e.g., by a screw, urges selected portions at the sides of the corner connector, e.g., portions of the side walls, towards the respective side walls of the channel. Thus, when the L-shaped member is disposed in the open rectangular channel, and when the screw is caused to enter the aperture, portions at the lateral faces of the L-shaped member are expanded outwardly, thereby frictionally to grip only the inner faces of the open rectangular channel.

By one embodiment of this invention, then, a picture frame is provided comprising a plurality of unitary members having identically shaped cross-sections and joined end-to-end to enclose a predetermined area, each of the members having, in cross section, a channel having a base, a pair of opposed side walls and a pair of inwardly directed flanges to define an open face and a slot to receive a material to be displayed in the area; and an L-shaped locking bracket within the channel, the locking bracket being of generally, rectangular, hollow cross-section, having an upper roof, a pair of opposed side walls and a split base, the split base having mutually opposed beveled edges, and an internally threaded hole in the roof with a set screw provided therein which, when tightened, engages the split base and forces selected portions at the opposed side walls of the locking bracket against the corresponding opposed side walls of the channel.

By another embodiment of this invention, an improvement is provided, in the combination of a picture frame molding formed from pieces of molding mitered at their free ends and a clamping assembly for interconnecting the pieces, the molding having a front, an inner side, an outer side side and a back, the molding having a picture retaining formation on its inner side, the molding having a generally rectangular channel with side walls adapted to house the clamping assembly, the clamping assembly comprising a locking bracket of generally L-shape and being of generally rectangular, hollow, cross-section, and having an upper roof, a pair of opposed side walls and a split base, the split base having mutually opposed beveled edges, an internally threaded hole in the roof, and bolts extending through the holes and threadedly engaging therein, the bolts when tightened engaged the split base and thereby to tighten and forcingly to clamp selected portions at the opposed side walls of the clamping assembly against corresponding opposed side walls of the generally rectangular channel.

By yet another embodiment of this invention, an improvement is provided in a picture frame formed from frame sections, each of the frame sections having a generally rectangular channel, an improved means for securing an adjacent pair of the sections together at a corner junction comprising: (a) an L-shaped, hollow, generally rectangular, locking bracket constituted by an upper roof, a pair of opposed side walls and a split base, the split base having mutually opposed beveled edges and having a pair of legs disposed at an angle substantially identical to the angle made by the frame sections at the corner junction, the legs being adapted to fit within the channels of adjacent frame sections at the corner junction, the legs being of a width which is sufficient to retain the bracket within the channels; and (b) locking means for urging selected portions at the side walls towards the sides of the channels, the locking means being manually operable for engaging the split base and, thereby to cause movement of selected portions of the opposed side walls of the bracket leg towards the corresponding opposed side walls of the frame section engaged therewith the split base comprises a longitudinally split wall opposite to the internally threaded hole in the roof, the split defining a pair of cooperating, beveled cam, lateral abutting camming edges the split base includes an aperture therein, the aperture being aligned with, and opposite to, the internally threaded hole, the aperture having countersunk apertured walls.

By another feature of these embodiments, the split base includes an aperture therein, the aperture being aligned with, and opposite to, the internally threaded hole, the aperture having raised, beveled conical walls.

By another feature, the locking bracket includes screw means engaging a portion of the inside face of the longitudinally split wall, thereby to urge selected portions at the sidewalls of the locking bracket into frictional engagement mainly with adjacent respective side walls of the channel.

By still another feature, the locking bracket includes screw means engaging overlapped beveled edges of the inside face of the longitudinally split wall, thereby to urge selected portions at the side walls of the locking bracket into frictional engagement mainly with adjacent respective side walls of the channel.

By yet another feature, the locking bracket includes screw means engaging the wider open end of the countersunk apertured walls of the aperture which defines a frusto-conical cup on the bottom of the locking bracket, thereby to urge selected portions at the side walls of the locking bracket into frictional engagement mainly with adjacent respective side walls of the channel.

By a still further feature, the locking bracket includes screw means engaging open end of the raised beveled conical walls of the aperture which defines a countersunk frusto-conical hole in the bottom of the locking bracket, thereby to urge selected portions at the side walls of the locking bracket into frictional engagement mainly with adjacent respective side walls of the channel.

By another feature of these embodiments of this invention, a method is provided of securing picture frame members together at a corner by an upper roof, having an internally threaded aperture therethrough, a pair of opposed sidewalls, and a split base, the split base having mutually opposed beveled edges, which locking corner is inserted within a rectangular cross-sectional channel in the frame members, which method comprises: threading a screw into the internally threaded aperture in the upper roof of the locking corner to engage means only on the mutually opposed split base, thereby to force selected portions at the wide walls into frictional engagement mainly with adjacent respective side walls of the channel.

BRIEF DESCRIPTION OF THE DRAWINGS

In the accompanying drawings.

DESCRIPTION OF PREFERRED EMBODIMENTS

Figure 1:
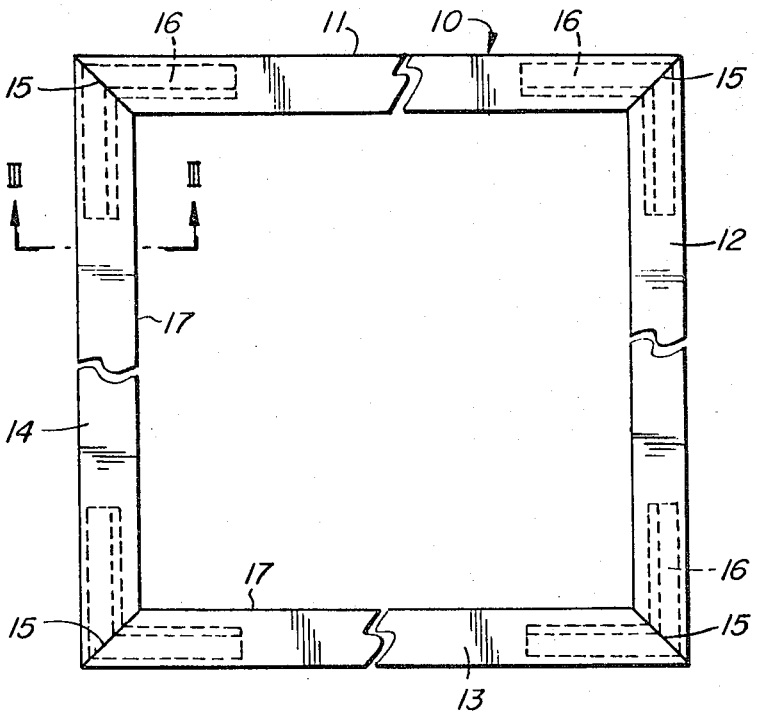
FIG. 1 is a top plan view of a picture frame provided with corners according to this invention.
Figure 2:
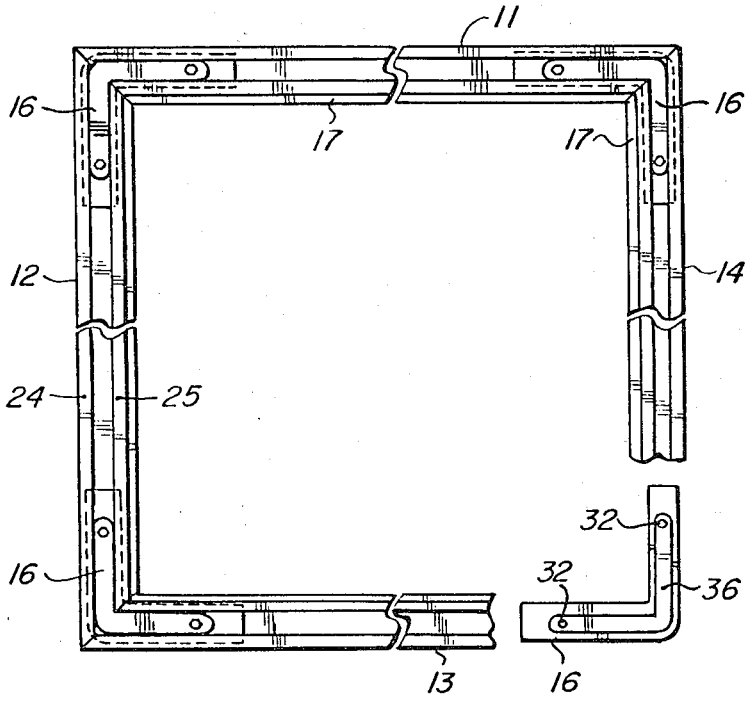
FIG. 2 is a bottom exploded plan view of a picture frame to be provided with corners according to this invention.
Figure 3:
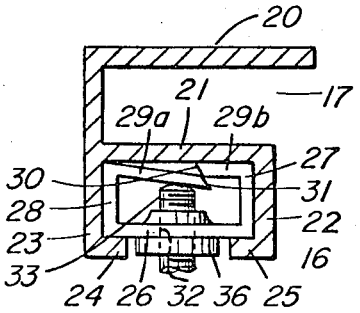
FIG. 3 is a section along the line III—III of FIG. 1.
Figure 6:
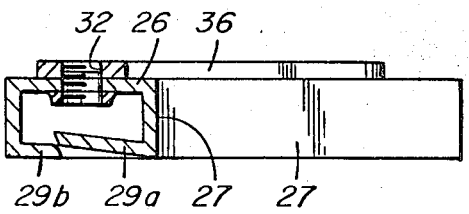
FIG. 6 is a section along the line VI—VI of FIG. 4.
Figure 4:
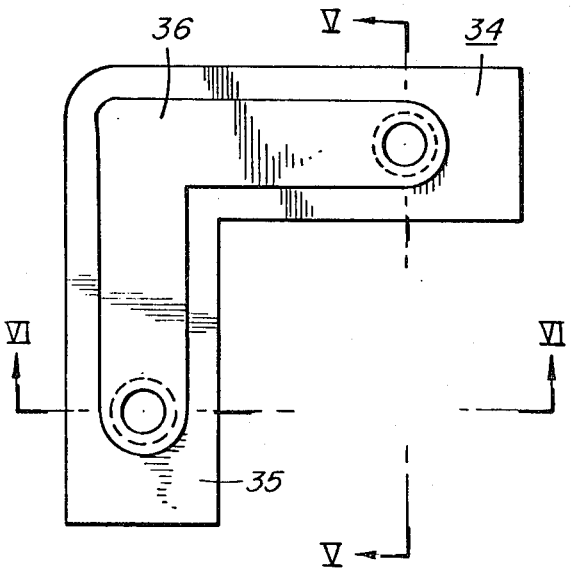
FIG. 4 is a top plan view of the corner of this invention.
Figure 5:
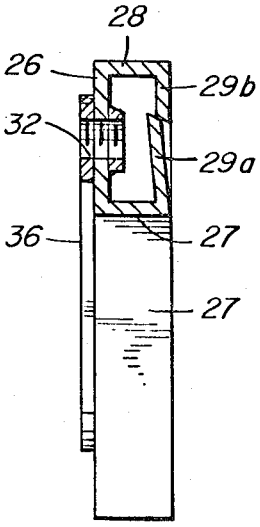
FIG. 5 is a section along the line V—V of FIG. 4.
Figure 7:
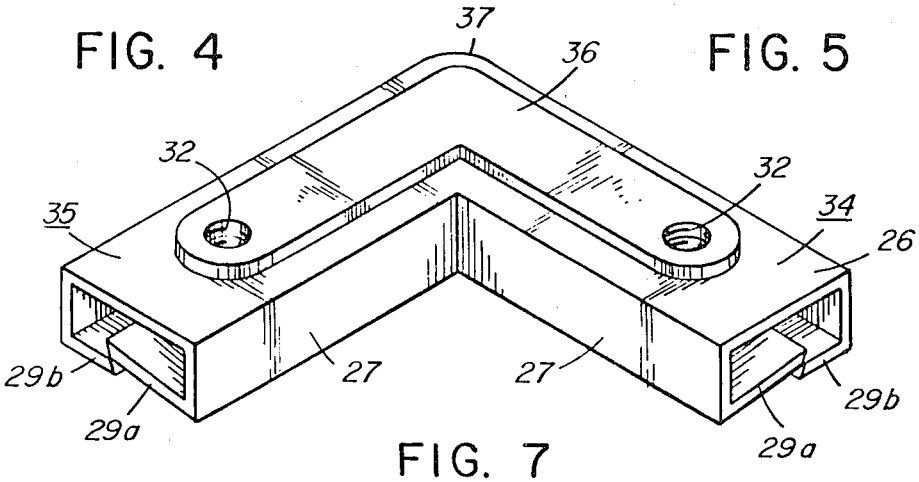
FIG. 7 is a top perspective view of a corner of this invention.
Figure 8:
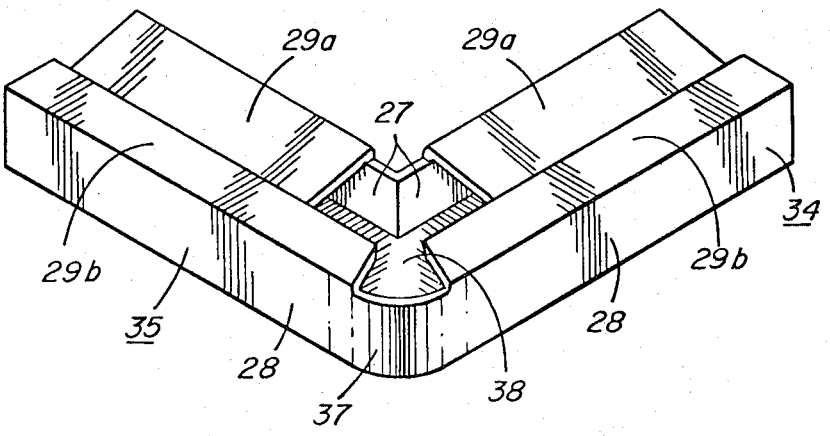
FIG. 8 is a bottom perspective view of the corner of FIG. 7.

Description of FIGS. 1–3

As seen in FIGS. 1 and 2, the frame 10 includes four side frame members 11, 12, 13 and 14 each having 45° angled ends 15. The edges 15 are joined together using the locking corner 16 of this invention. The frame 10 thus provides a picture retaining channel 17 on its inwardly directed side.

The frame 10 is preferably made of aluminum, but it can be made of other materials including other metals, plastics, wood or plaster. The particular type of material used will depend on its ease and cost of fashioning into the parts required and its overall attractiveness in the finished frame.

The frame as shown in FIGS. 1 and 2 is made from a combination of two basic elements, namely the side frame members 11–14 and the locking corners 16. To make the frame only four side frame members need be used, along with four locking corners.

The cross-section of each of the side frame members (only one, namely 11, being shown, for example) is seen in FIG. 3. The cross-section is such as to provide a common outer edge 23 defining one edge of retaining channel 17 and one edge of a lower rectangular channel. Retaining channel 17 is defined by an upper facia 20 and a common dividing wall 21 between the lower rectangular channel. Lower rectangular channel is defined by a common outer edge 23, common dividing wall 21 and inner edge 22, as well as a longitudinal slot constituted between a pair of spaced-apart, facing flanges 24, 25.

The locking corner 16, in cross-section shown in FIG. 3, is of generally rectangular box-like form, defined by a floor 26, a pair of mutually opposed side walls 27, 28 and a split roof *29a*, *29b*, having a pair of cooperating beveled cam edges 30, 31. The floor 26 is provided with an internally threaded aperture 32 through which a threaded bolt 33 is adapted to pass.

Description of FIGS. 4–8

FIGS. 4–8 show one embodiment of a locking corner of this invention. The locking corner 16 is of generally L-shaped configuration and includes two legs 34, 35. The floor 26 includes a raised L-shaped embossment 36 to provide additional reinforcement. The internally threaded holes 32 are provided, one through each leg 34, 35 and through the embossment 36. The holes are preferably extruded in order to provide a maximum number of threads. The outer edge 37 of the corner between the two legs 34, 35 is rounded, and a bottom and side wall slot 38 is provided. Thus, the corner is drawn to provide additional reinforcement.

Figure 9:
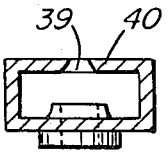
FIG. 9 is a cross-section through one leg of the corner of this invention.
Figure 10:
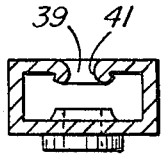
FIG. 10 is a cross-section through one leg of the corner of this invention.

Description of FIGS. 9 and 10

Two alternative ways of urging the mutually opposed side walls apart are shown in FIGS. 9 and 10. In FIG. 9, this takes the form of an aligned aperture 39 having countersunk beveled edges 40. in FIG. 10, this takes the form of an aligned aperture 39 having raised beveled conical walls 41.

While not shown in the drawings, the legs of each corner are U-shaped and the bottom at each leg of the corner may comprise a folded-over split sub-floor, with the screw means adapted to engage the slit provided by the split. The marginal side walls of the sub-floor are provided with wing-like projections which project through detents in the side walls of the U-shaped corner. The screw thus urges the wing-like projection into frictional engagement mainly with the side walls of the channel.

While also not shown, the corner frame may consist of a cast plastics material, e.g., polyethylene, polypropylene, polyvinyl chloride, etc. The upper face is longitudinally slit to accommodate the engagement screw. The bottom face is provided with a pair of spaced-apart lateral slits. The screw thus urges the lateral portions outboard of the slits into frictional engagement mainly with the side walls.

Operation of Preferred Embodiment

In use, and as shown in FIG. 3, when the locking corner is inserted in the lower rectangular channel of the side frame members to provide a right angle corner, the threaded bolt is rotated. This causes the lower end of the bolt to press against the split roof and thus urge the beveled cam edges towards each other. This causes the split roof to be spread apart and thus causes the opposed side walls to exert pressure and frictional contact with the respective adjacent side walls of the lower rectangular channel.

Summary

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A picture frame comprising: a plurality of unitary members having identically shaped cross-sections and joined end-to-end to enclose a predetermined area, each of said members having in cross-section, a channel having a base, a pair of opposed side walls and a pair of inwardly directed flanges to define an open face and a slot to receive a material to be displayed in said area; and an L-shaped locking bracket within said channel, said locking bracket being of generally rectangular hollow cross-section, having an upper roof, a pair of opposed side walls and a split base, said split base having mutually opposed beveled edges, and an internally threaded hole in said roof with a set screw provided therein which, when tightened, engages said split base and forces selected portions at said opposed side walls of said locking bracket against the corresponding opposed side walls of said channel.

2. The picture frame of claim 1 wherein said split base comprises a longitudinally split wall opposite to said internally threaded hole in said roof, said split defining a pair of cooperating beveled lateral abutting camming edges.

3. The picture frame of claim 1 wherein said split base includes an aperture therein, said aperture being aligned with, and opposite to, said internally threaded hole, said aperture having countersunk apertured walls.

4. The picture frame of claim 1 wherein said split base includes an aperture therein, said aperture being aligned with, and opposite to, said internally threaded hole, said aperture having raised, beveled conical walls.

5. In combination, a picture frame molding formed from pieces of molding mitered at their free ends and a clamping assembly for interconnecting said pieces, said molding having a front, an inner side, an outer side and a back, said molding having a picture-retaining formation on its inner side, said molding having a generally rectangular channel with side walls adapted to house said clamping assembly, said clamping assembly comprising: a locking bracket of generally L-shape and being of generally rectangular hollow cross-section, and having an upper roof, a pair of opposed side walls and a split base, said split base having mutually opposed beveled edges, an internally threaded hole in said roof, and bolts extending through said holes and threadedly engaging therein, said bolts when tightened engaging said split base and thereby to tighten and forcingly to clamp selected portions at said opposed side walls of said clamping assembly against corresponding opposed side walls of said generally rectangular channel.

6. The picture frame of claim 5 wherein split base comprises a longitudinally split wall opposite to, said internally threaded hole in said roof said split defining a pair of cooperating beveled lateral abutting camming edges.

7. The picture frame of claim 5 wherein said split base includes an aperture therein, said aperture being aligned with, and opposite to, said internally threaded hole, said aperture having countersunk apertured walls.

8. The picture frame of claim 5 wherein said split base includes an aperture therein, said aperture being aligned with, and opposite to, said internally threaded hole, said aperture having raised, beveled conical walls.

9. In a picture frame formed from frame sections, each of said frame sections having a generally rectangular channel, an improved means for securing an adjacent pair of said sections together at a corner junction comprising:

(a) an L-shaped, hollow, generally rectangular locking bracket constituted by an upper roof, a pair of opposed side walls and a split base, said split base having mutually opposed beveled edges and having a pair of legs disposed at an angle substantially identical to the angle made by said frame sections at said corner junction, said legs being adapted to fit within the said channels of adjacent frame sections at said corner junction, said legs being of a width which is sufficient to retain said bracket within said channels; and (b) locking means for uging selected portions at the side walls towards the sides of said channels, said locking means being manually operable for engaging said split base and, thereby to cause movement of selected portions at said opposed side walls of said bracket leg towards the corresponding opposed side walls of said frame section engaged therewith.

10. The picture frame of claim 9 wherein said split base comprises a longitudinally split wall opposite to, said internally threaded hole in said roof said split defining a pair of cooperating beveled lateral abutting camming edges.

11. The picture frame of claim 9 wherein said split base includes an aperture therein, said aperture being aligned with, and opposite to, said internally threaded hole, said aperture having countersunk apertured walls.

12. The picture frame of claim 9 wherein said split base includes an aperture therein, said aperture being aligned with, and opposite to, said internally threaded hole, said aperture having raised, beveled conical walls.

13. The picture frame of claims 2, 6 or 10 wherein said locking bracket includes screw means engaging a portion of the inside face of said longitudinally split wall, thereby to urge selected portions at the side walls of said locking bracket into frictional engagement mainly with adjacent respective side walls of said channel.

14. The picture frame of 2, 6 or 10 wherein said locking bracket includes screw means engaging overlapped beveled edges of the inside face of said longitudinally split wall, thereby to urge selected portions at the side walls of said locking bracket into frictional engagement mainly with adjacent respective side wall of said channel.

15. The picture frame of claims 3, 7 or 11 wherein said locking bracket includes screw means engaging the wider open end of the countersunk apertured walls of the aperture which defines a frusto-conical cup on the bottom of said locking bracket, thereby to urge selected portions at the side walls of said locking bracket into frictional engagement mainly with adjacent respective side walls of said channel.

16. The picture frame of claims 4, 8 or 12 wherein said locking bracket includes screw means engaging the wider open end of the raised beveled conical walls of the aperture which defines a countersunk frusto-conical hole in the bottom of said locking bracket, thereby to urge selected portions at the side walls of said locking bracket into frictional engagement mainly with adjacent respective side walls of said channel.

17. A method of securing picture frame members together at a corner by means of a hollow rectangular cross-section locking corner constituted by an upper roof, having an internally threaded aperture therethrough, a pair of opposed sidewalls, and a split base, said split base having mutually opposed beveled edges, which locking corner is inserted within a rectangular cross-section channel in the frame members, which method comprises: threading a screw into said internally threaded aperture in said upper roof of the locking corner to engage means only on the mutually opposed split base, thereby to force selected portions at the side walls into frictional engagement mainly with adjacent respective side walls of said channel.

* * * * *

UNITED STATES PATENT AND TRADEMARK OFFICE

CERTIFICATE OF CORRECTION

PATENT NO. : 4,377,915

DATED : March 29, 1983

INVENTOR(S) : ZOSSIMAS et al

It is certified that error appears in the above-identified patent and that said Letters Patent are hereby corrected as shown below:

In the Heading of the Patent change "[75] Inventors: Efthimios Zossimas; Michael Dodis, both of Toronto, Canada" to --[75] Inventors: Efthimios Zossimas, Toronto; Michael Dodis, Toronto; Rolf Hoffman, Scarboro, all of Canada--.

Signed and Sealed this

*Sixth* Day of *December 1983*

[SEAL]

*Attest:*

GERALD J. MOSSINGHOFF

*Attesting Officer*

*Commissioner of Patents and Trademarks*